United States Patent [19]

Fry

[11] Patent Number: 5,007,868

[45] Date of Patent: Apr. 16, 1991

[54] REPLACEABLE SKEG FOR A MARINE PROPULSION DEVICE

[76] Inventor: Trenton Fry, Northland Lodge, Orr, Minn. 55771

[21] Appl. No.: 468,254

[22] Filed: Jan. 22, 1990

[51] Int. Cl.[5] ..... B63H 5/16

[52] U.S. Cl. ..... 440/071; 440/113; 114/126; 114/140; 441/79

[58] Field of Search ..... 440/49, 51, 56, 113, 440/78, 71; 441/79; 114/126, 140, 142

[56] References Cited

U.S. PATENT DOCUMENTS 1,730,844 10/1929 Dupuis ..... 114/140

2,119,881 6/1938 Kline ..... 114/140

2,429,774 10/1947 Schultz et al. ..... 440/78

*Primary Examiner*—Jesûs D. Sotelo

*Attorney, Agent, or Firm*—Michael I. Kroll

[57] ABSTRACT

A replaceable skeg for a marine propulsion device is provided and includes a tapered dovetail tongue and groove joint between top of the skeg and lower portion of a gear case housing on the marine propulsion device. When the skeg is hit by an underwater obstruction it will fracture at the joint and break away, leaving the lower portion of the gear case housing intact and undamaged in which another skeg can be installed thereto.

2 Claims, 1 Drawing Sheet

Fig 1
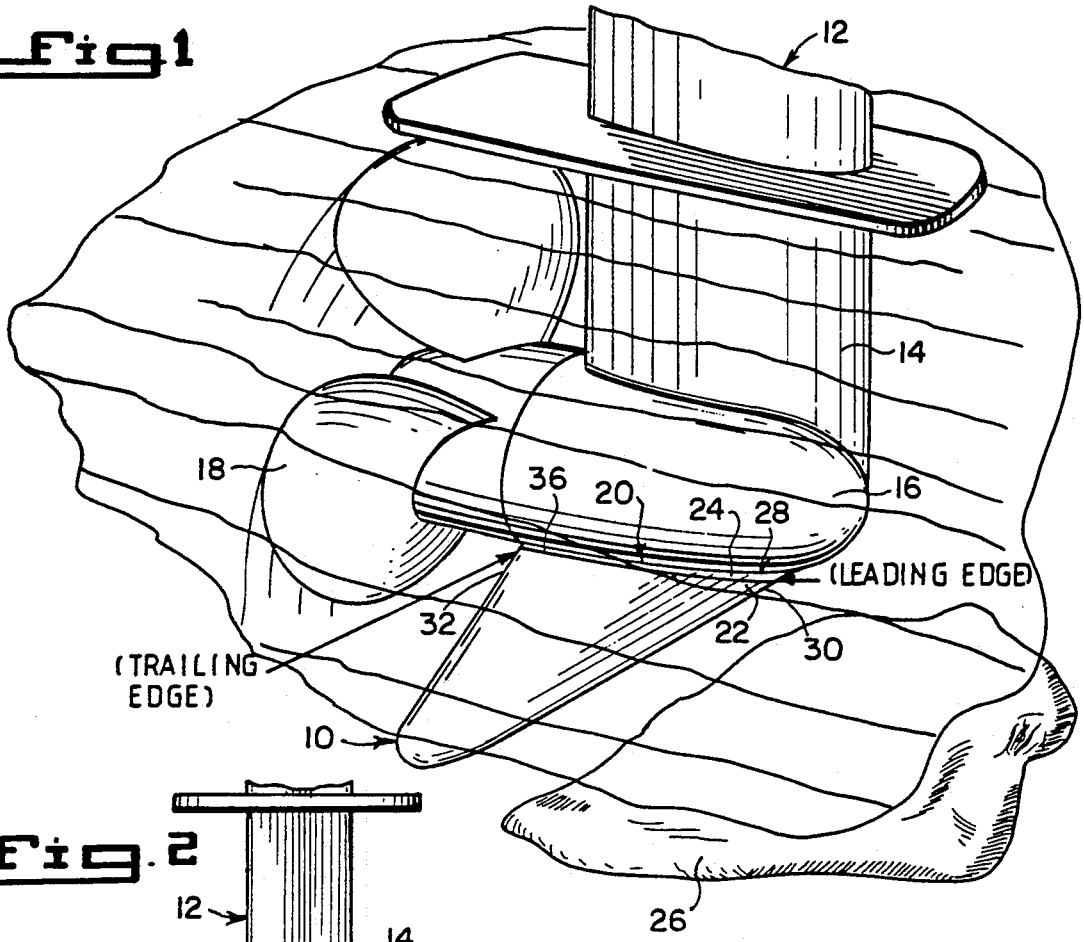
Fig. 2
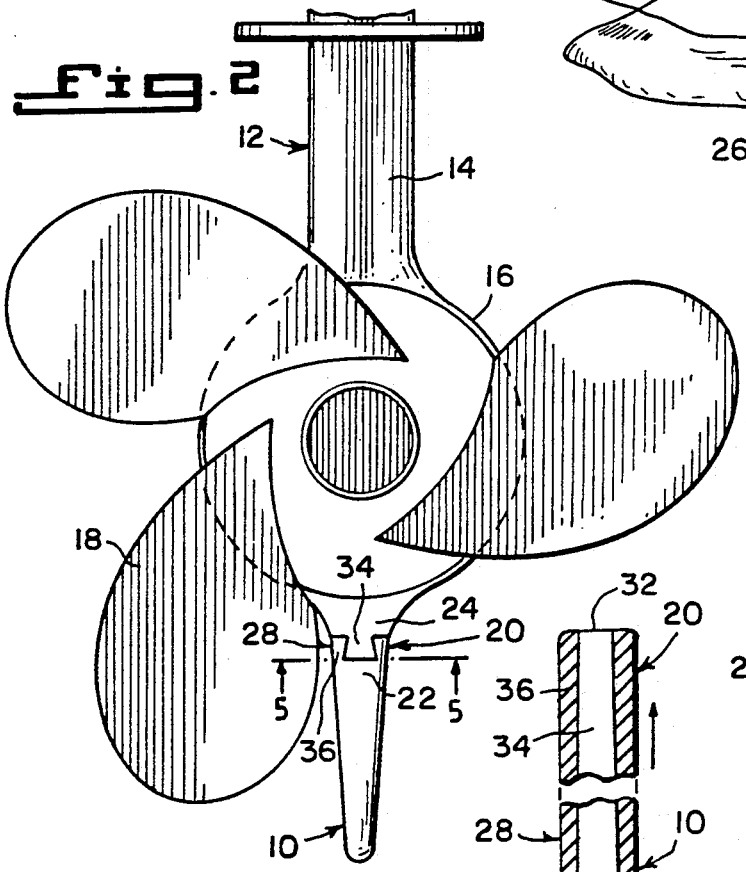
Fig 3
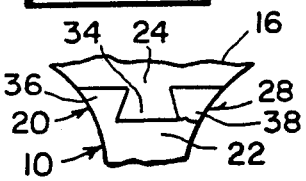
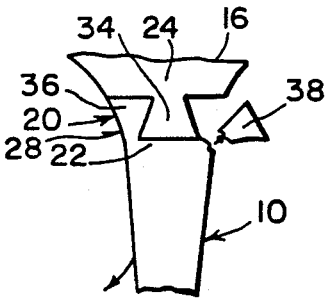
Fig. 4
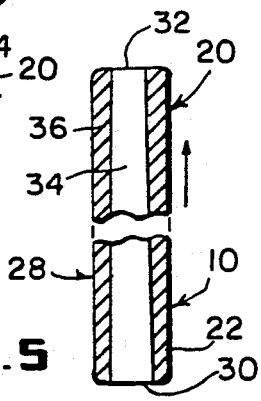
Fig. 5

REPLACEABLE SKEG FOR A MARINE PROPULSION DEVICE

BACKGROUND OF THE INVENTION

1. Field of the Invention

The instant invention relates generally to outboard engines and more specifically it relates to a replaceable skeg for a marine propulsion device.

2. Description of the Prior Art

Numerous outboard engines have been provided in prior art that are adapted to include fixed stationary skegs which when hit by underwater obstruction and get damaged must be rebuilt or the entire lower unit replaced. For example, U.S. Pat. No. 2,956,533 to DeYo and U.S. Pat. No. 4,563,155 to Blanchard are illustrative of such prior art. While these units may be suitable for the particular purpose to which they address, they would not be as suitable for the purposes of the present invention as heretofore described.

SUMMARY OF THE INVENTION

A primary object of the present invention is to provide a replaceable skeg for a marine propulsion device that will overcome the shortcomings of the prior art devices.

Another object is to provide a replaceable skeg for a marine propulsion that is removably connected to the lower portion of the gear case housing so that when hit by an under water obstruction it will fracture and break away, leaving the lower portion of the gear case housing in tact and undamaged.

An additional object is to provide a replaceable skeg for a marine propulsion device in which a tapered dovetail tongue and groove joint between the skeg and the lower portion of the gear case housing will ensure a tight fit for the skeg.

A further object is to provide a replaceable skeg for a marine propulsion device that is simple and easy to use.

A still further object is to provide a replaceable skeg for a marine propulsion device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a bottom segment of a marine propulsion device with the invention installed thereon.

FIG. 2 is a rear view thereof.

FIG. 3 is an enlarged detail view of the tapered dovetail tongue and groove joint showing the fracture.

FIG. 4 is an enlarged detail view similar to FIG. 3 showing the break away portion after the fracture is complete.

FIG. 5 is a cross sectional view taken along line 5—5 in FIG. 2, showing the tapered dovetail tongue and groove joint in greater detail.

DETAILED DESCRIPTION OF THE PREFERED EMBODIMENTS

Turning now descriptively to the drawings, in which similar reference characters denote similar elements throughout the several views, the Figures illustrate a replaceable skeg 10 for a marine propulsion device 12 of the type having a drive shaft housing 14, a gear case housing 16 fixed to bottom end of the drive shaft housing 14 and a rotatably mounted propelling element 18 on the rear end of the gear case housing 16. The skeg 10 contains a structure 20 for removably connecting top 22 of the skeg 10 to lower portion 24 of the gear case housing 16. When the skeg 10 is hit by an underwater obstruction 26, the skeg 10 will fracture at the removable connecting structure 20 and break away, leaving the lower portion of the gear case housing 16 in tact and undamaged in which another skeg 10 can be installed thereto.

The removable connecting structure 20 includes a dovetail tongue and groove joint 28 between the top 22 of the skeg 10 and the lower portion 24 of the gear case housing 16. The dovetail tongue and groove joint 28 is tapered, being wider at leading edge 30 and narrower at trailing edge 32 of the top 22 of the skeg 10 and the lower portion 24 of the gear case housing 16 to ensure a tight fit for the skeg 10.

The joint 26 includes a tapered dovetail tongue 34 located on the lower portion 24 of the gear case housing 16. A tapered dovetail groove 36 is located on the top 22 of the skeg 10 so that the fracture will cause part 38 of the top 22 of the skeg 10 to break away at the tapered dovetail groove 36, leaving the tapered dovetail tongue 34 in tact and undamaged.

LIST OF REFERENCE NUMBERS

10 replaceable skeg
12 marine propulsion device
14 drive shaft housing
16 gear case housing
18 rotatably mounted propelling element
20 removable connecting structure
22 top of 10
24 lower portion of 16
26 underwater obstruction
28 dovetail tongue and groove joint
30 leading edge
32 trailing edge
34 tapered dovetail tongue
36 tapered dovetail groove
38 fracture part of 36

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A replaceable skeg for a marine propulsion device of the type having a drive shaft housing, a gear case housing fixed, to the bottom end of the drive shaft housing and rotatably mounted propelling element on the rear end of the gear case housing, said skeg comprising a means for removably connecting the top of said skeg to the lower portion of the gear case housing so that when said skeg is hit by an underwater obstruction, said skeg will fracture at said removable connecting means and break away, leaving the lower portion of the gear case housing intact and undamaged in which another said skeg can be installed thereto, wherein said removable connecting means includes a dovetail tongue and groove joint between the top of said skeg and the lower portion of the gear case housing, and wherein said dovetail tongue and groove joint is tapered, being wider at the leading edge and narrower at the trailing edge of the top of said skeg and the lower portion of the gear case housing to ensure a tight fit for said skeg.

2. A replaceable skeg as recited in claim 1, wherein said joint includes a tapered dovetail tongue located on the lower portion of the gear case housing and a tapered dovetail groove located on the top of said skeg so that the fracture will cause part of the top of said skeg to break away at said tapered dovetail groove leaving said tapered dovetail tongue in tact and undamaged.

* * * * *